US012358704B2

(12) United States Patent
Stepkowski et al.

(10) Patent No.: US 12,358,704 B2
(45) Date of Patent: Jul. 15, 2025

(54) ARTICLE CARRIER AND BLANK THERFOR

(71) Applicant: WestRock Packaging Systems, LLC, Atlanta, GA (US)

(72) Inventors: Bartlomiej Stepkowski, Lomianki Dolne (PL); Julien D. Merzeau, Châteauroux (FR); Christian Labergere, Ardentes (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/596,565

(22) Filed: Mar. 5, 2024

(65) Prior Publication Data

US 2024/0208704 A1 Jun. 27, 2024

Related U.S. Application Data

(63) Continuation of application No. 17/791,513, filed as application No. PCT/US2021/012410 on Jan. 7, 2021, now Pat. No. 11,919,690.

(Continued)

(51) Int. Cl.
*B65D 71/18* (2006.01)
*B65D 71/30* (2006.01)

(52) U.S. Cl.
CPC ..... *B65D 71/18* (2013.01); *B65D 71/30* (2013.01); *B65D 2571/00197* (2013.01); *B65D 2571/00265* (2013.01); *B65D 2571/00444* (2013.01); *B65D 2571/00469* (2013.01); *B65D 2571/0066* (2013.01); *B65D 2571/00716* (2013.01)

(58) Field of Classification Search
CPC ..... B65D 71/18; B65D 71/20; B65D 71/22; B65D 71/26; B65D 71/30; B65D 71/32; B65D 71/34; B65D 2571/00197; B65D 2571/00265; B65D 2571/00444;
(Continued)

(56) References Cited

U.S. PATENT DOCUMENTS 2,837,262 A 6/1958 Ullrich
2,888,135 A 5/1959 Guyer
(Continued)

FOREIGN PATENT DOCUMENTS

DE 1293674 B 4/1969
FR 1418015 A 11/1965
(Continued)

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to a package, an article carrier for packaging a plurality of articles and to a blank for forming the article carrier. The article carrier may package at least one article having a recess. The article carrier comprises a plurality of panels for forming a tubular structure for surrounding at least one article. The article carrier comprises an article retention device for engaging a recess of one of said at least one article. The article retention device may inhibit dislodgement of the article from at least one of opposite open ends of the tubular structure in a setup carrier. The tubular structure defines a tubular axis. The article retention device comprises a flap hingedly connected to a first one of the plurality of panels along a first fold line. The first fold line extends at an acute angle with respect to the tubular axis. The acute angle may be no more than 50 degrees.

20 Claims, 9 Drawing Sheets

Related U.S. Application Data

(60) Provisional application No. 62/964,404, filed on Jan. 22, 2020, provisional application No. 62/957,987, filed on Jan. 7, 2020.

(58) Field of Classification Search
CPC .. B65D 2571/00469; B65D 2571/0066; B65D 2571/00716
See application file for complete search history.

(56) References Cited

U.S. PATENT DOCUMENTS

| | | | |
|---|---|---|---|
| 3,134,532 | A | 5/1964 | Bixby |
| 3,253,381 | A | 5/1966 | Wood |
| 3,273,782 | A | 9/1966 | Chidsey, Jr. |
| 3,314,590 | A | 4/1967 | Tolaas |
| 3,450,332 | A | 6/1969 | Padovano |
| 4,693,412 | A | 9/1987 | Yeaman, Sr. |
| 11,305,924 | B2 | 4/2022 | Smalley |
| 2013/0098977 | A1 | 4/2013 | May |

FOREIGN PATENT DOCUMENTS

| | | | |
|---|---|---|---|
| FR | 1589340 | A | 3/1970 |
| WO | 2005/044549 | A2 | 5/2005 |

ARTICLE CARRIER AND BLANK THERFOR

CROSS-REFERENCE TO RELATED APPLICATIONS

This application claims priority of U.S. Provisional Patent Application No. 62/957,987, filed Jan. 7, 2020 and U.S. Provisional Patent Application No. 62/964,404, filed Jan. 22, 2020, the disclosures of which are herein incorporated by reference in their entireties.

TECHNICAL FIELD

The present invention relates to article carriers and to blanks for forming the same. More specifically, but not exclusively, the invention relates to an article retention structure including an engagement device for securing an end of an article. Aspects of the invention relate to a wraparound carrier having a carrying handle.

BACKGROUND

In the field of packaging it is known to provide cartons or article carriers for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the carton comprises a carrying handle sufficiently strong enough to bear the load of the carton and its contents.

It is desirable that the articles held within a carton are securely held and protected during transportation. It is also desirable that the articles within a carton can be readily accessed.

The present invention seeks to provide an improvement in the field of cartons, typically formed from paperboard or the like.

SUMMARY

A first aspect of the invention provides a blank for forming an article carrier. The article carrier may package at least one article having a recess. The blank comprises a plurality of panels for forming a tubular structure for surrounding at least one article. The blank comprises an article retention device for engaging a recess of one of said at least one article. The article retention device may inhibit dislodgement of the article from at least one of opposite open ends of the tubular structure in a setup carrier. The tubular structure defines a tubular axis. The article retention device comprises a flap hingedly connected to a first one of the plurality of panels along a first fold line. The first fold line extends at an acute angle with respect to the tubular axis. The acute angle may be no more than 50 degrees.

Optionally, the flap is hingedly connected such that the flap is foldable inwardly of the carrier toward a second one of the plurality of panels which is hingedly connected to the first one of the plurality of panels along a second fold line, the second fold line being parallel to the tubular axis.

Optionally, the flap is defined, at least in part, by at least one cut line in the first one of the plurality of panels, the at least one cut line has at least one curved end which is located adjacent to and directed toward one end of the first fold line.

Optionally, the at least one curved end is connected to the one end of the first fold line.

Optionally, the acute angle is no less than 10 degrees and no more than 30 degrees.

A second aspect of the invention provides a blank for forming an article carrier. The article carrier may package at least one article having a recess. The blank comprises a plurality of panels for forming a tubular structure for surrounding at least one article. The blank comprises an article retention device for engaging a recess of one of said at least one article. The article retention device may inhibit dislodgement of the article from at least one of opposite open ends of the tubular structure in a setup carrier. The article retention device comprises a flap struck from only a first one of the plurality of panels and hingedly connected to the first one of the plurality of panels along a first fold line. The flap, when folded about the first fold line, defines at least part of a machine pull opening. A machine element may engage the machine pull opening to tighten the blank around the at least one article. The flap may be a single or unitary member formed from the material removed out from the machine pull opening.

Optionally, the machine pull opening includes a recess along a perimeter of the machine pull opening, the recess being located at a position opposing the first fold line.

Optionally, the machine pull opening includes a recess along a perimeter of the machine pull opening, the recess being located at a position across the machine pull opening from the first fold line.

Optionally, the flap is defined, at least in part, by a cut line in the first one of the plurality of panels, the recess being located such that the recess interrupts the cut line and divides the cut line into two portions, the two portions of the cut line extending respectively from the recess to opposite ends of the first fold line respectively.

A third aspect of the invention provides a blank for forming an article carrier. The article carrier may package at least one article having a recess. The blank comprises a plurality of panels for forming a tubular structure for surrounding at least one article. The blank comprises an article retention device for engaging a recess of one of said at least one article. The article retention device may inhibit dislodgement of the article from at least one of opposite open ends of the tubular structure in a setup carrier. The blank comprises a longitudinal axis. The article retention device comprises a flap hingedly connected to a first one of the plurality of panels along a first fold line. The first fold line extends at an acute angle with respect to the longitudinal axis. The acute angle may be greater than 40 degrees and less than 90 degrees.

A fourth aspect of the invention provides an article carrier for packaging at least one article each having a recess. The article carrier comprises a plurality of panels for forming a tubular structure for surrounding at least one article. The article carrier comprises an article retention device for engaging a recess of one of said at least one article so as to inhibit dislodgement of the article from at least one of opposite open ends of the tubular structure. The tubular structure defines a tubular axis. The article retention device comprises a flap hingedly connected to a first one of the plurality of panels along a first fold line. The first fold line extends at an acute angle with respect to the tubular axis. The acute angle may be no more than 50 degrees.

A fifth aspect of the invention provides an article carrier for packaging at least one article each having a recess. The article carrier comprises a plurality of panels for forming a tubular structure for surrounding at least one article. The article carrier comprises an article retention device for engaging a recess of one of said at least one article so as to inhibit dislodgement of the article from at least one of opposite open ends of the tubular structure. The article retention device comprises a flap struck from only a first one of the plurality of panels and hingedly connected to the first one of the plurality of panels along a first fold line. The flap, when folded about the first fold line, defines at least part of a machine pull opening for a machine element to engage to tighten the blank around the at least one article. The flap may be a single or unitary member formed from the material removed out from the machine pull opening.

A sixth aspect of the invention provides an article carrier for packaging at least one article each having a recess. The article carrier comprises a plurality of panels for forming a tubular structure for surrounding at least one article. The article carrier comprises an article retention device for engaging a recess of one of said at least one article so as to inhibit dislodgement of the article from at least one of opposite open ends of the tubular structure. The article carrier comprises a transverse axis. The transverse axis is perpendicular to a tubular axis of the tubular structure. The article retention device comprises a flap hingedly connected to a first one of the plurality of panels along a first fold line. The first fold line extends at an acute angle with respect to the transverse axis. The acute angle may be greater than 40 degrees and less than 90 degrees.

A seventh aspect of the invention provides an article-engaging flap formed from a carton bottom panel and hingedly connected to the bottom panel. The engaging flap is defined in part by a free edge which includes a segment for forming a non-protrusion or truncation. The segment includes a part of the free edge which is disposed closest to a carton side panel in an erected form of the carton. The engaging flap is folded inwardly beyond 90 degrees toward the side panel.

Optionally, the segment is one selected from the group consisting of a straight segment, a concavely curved segment and a concavely angled segment.

Optionally, the engaging flap further comprises an engaging segment for engaging with a portion of an article.

An eighth aspect of the invention provides a blank for forming an article carrier for packaging at least one article each having a recess. The blank comprises a plurality of panels for forming a tubular structure for surrounding at least one article. The blank comprises an article retention device for engaging a recess of one of said at least one article to inhibit dislodgement of the article from at least one of opposite open ends of the tubular structure. The article retention device comprises a flap struck from a first one of the plurality of panels and hingedly connected thereto along a first fold line. The flap defines an opening in the first one of the plurality of panels when folded out of the plane of the first one of the plurality of panels. The opening includes a notch which is located along a free edge of the flap when the flap is at its initial unfolded position. The free edge includes a segment for forming a non-protrusion, truncation or re-entrant portion, the segment being disposed adjacent to the notch.

Optionally, the segment is located such that the segment defines a part of the notch when the flap is in the initial position.

Optionally, the segment is located such that the segment extends from the notch.

A ninth aspect of the invention provides a package comprising an article carrier and at least one article each having a recess. The article carrier comprises a plurality of panels for forming a tubular structure surrounding at least one article. The article carrier comprises an article retention device for engaging a recess of one of said at least one article to inhibit dislodgement of the article from at least one of opposite open ends of the tubular structure. The article retention device comprises a flap struck from a first one of the plurality of panels and hingedly connected thereto along a first fold line. The flap defines an opening in the first one of the plurality of panels when folded out of the plane of said panel. The opening includes a notch located along a free edge of the flap when the flap is at its initial unfolded position. The free edge includes a segment for forming a non-protrusion, truncation or re-entrant portion, the segment being disposed adjacent to the notch. The engaging flap may comprise an engaging segment in securing engagement with a portion of the at least one article.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and article carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and article carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
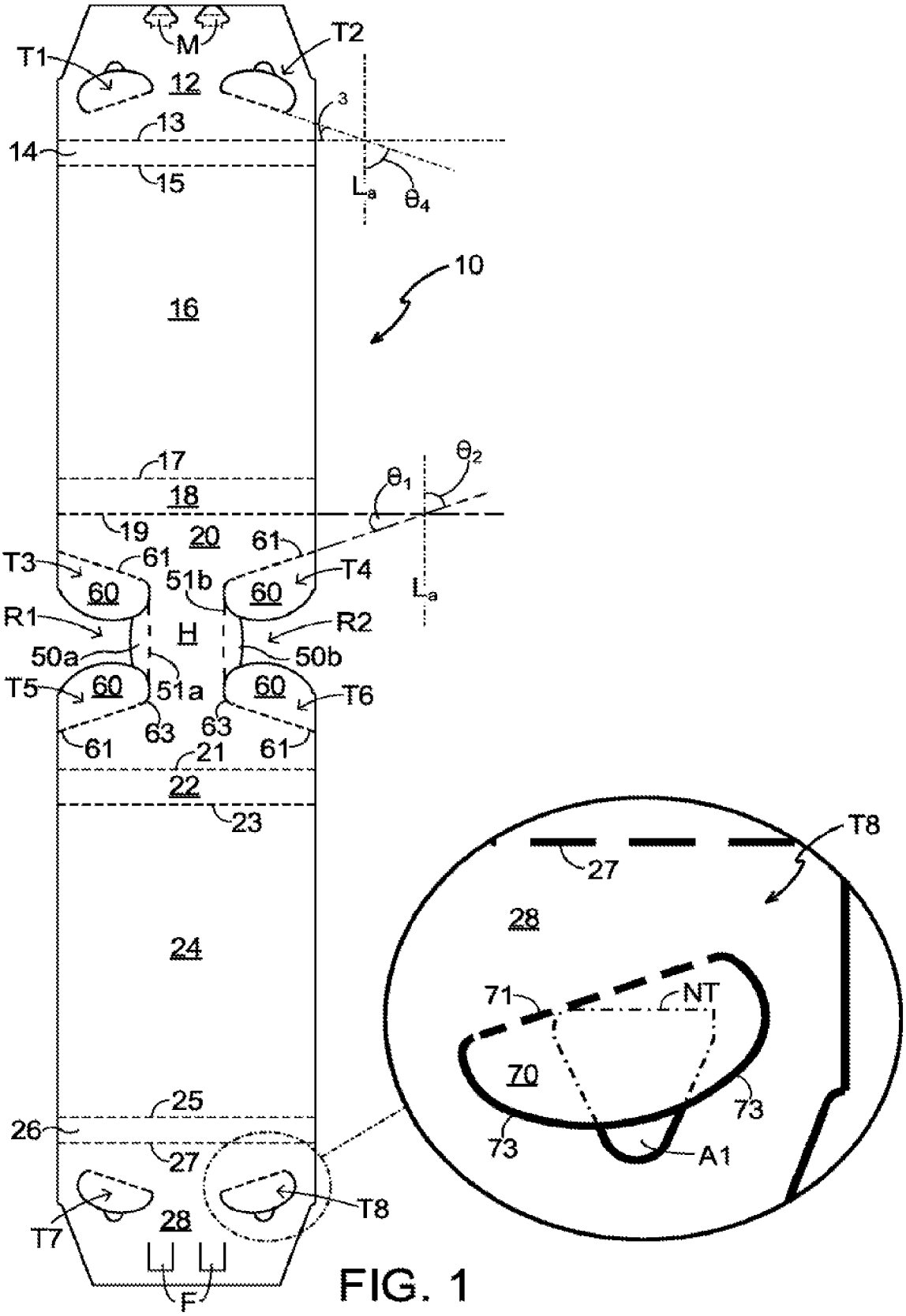
FIG. 1 is a plan view from above of a blank for forming an article carrier according to embodiments of the disclosure.
Figure 2:
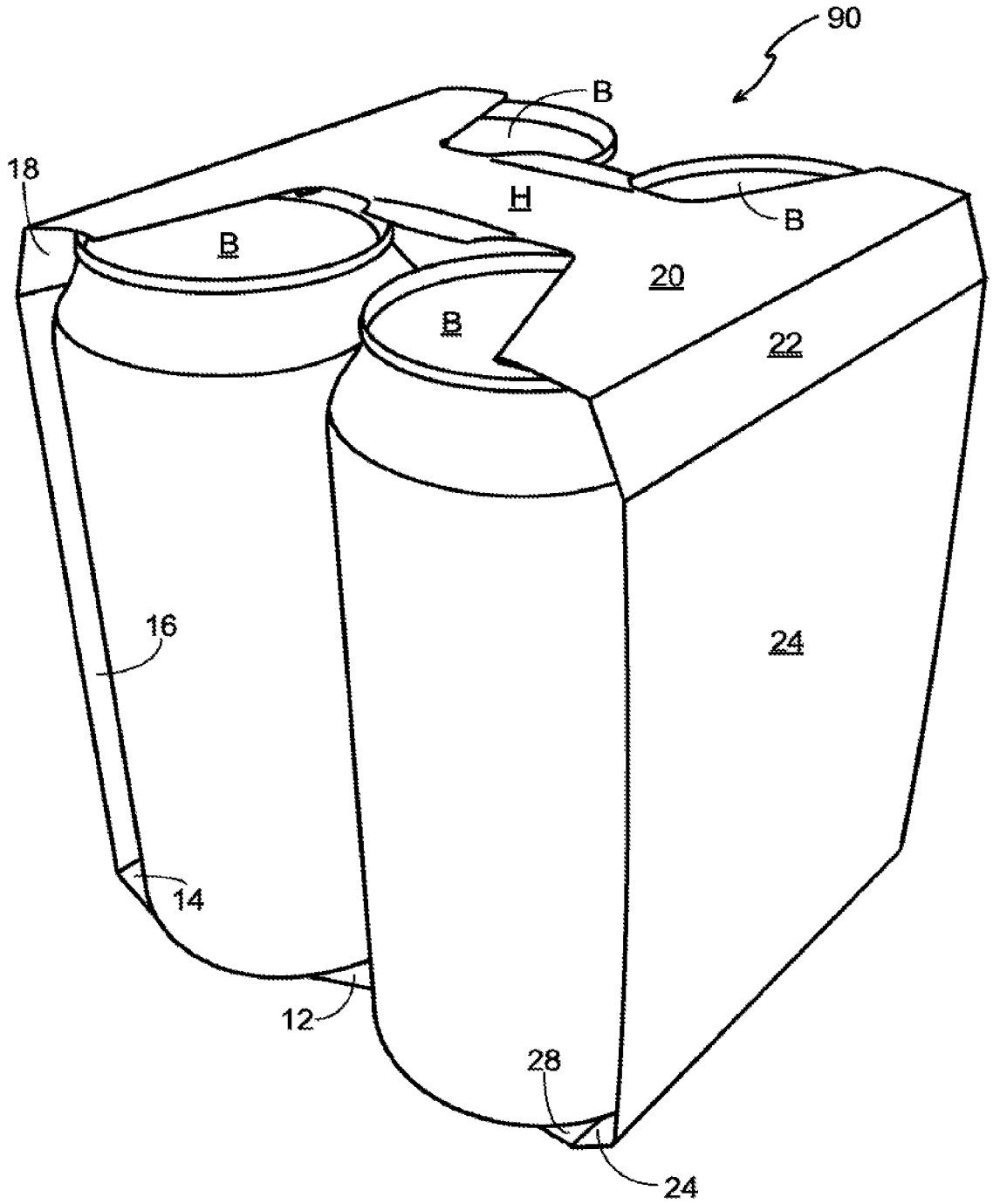
FIG. 2 is a perspective view of an article carrier formed from the blank of FIG. 1.

Referring to FIG. 1, there is shown a plan view of a blank 10 capable of forming a carton or carrier 90, as shown in FIG. 2, for containing and carrying a group of primary products such as, but not limited to, beverage cans, hereinafter referred to as articles B, as shown in FIG. 2. The blank 10 can be assembled to form a secondary package for packaging at least one primary product container or package.

Figure 4:
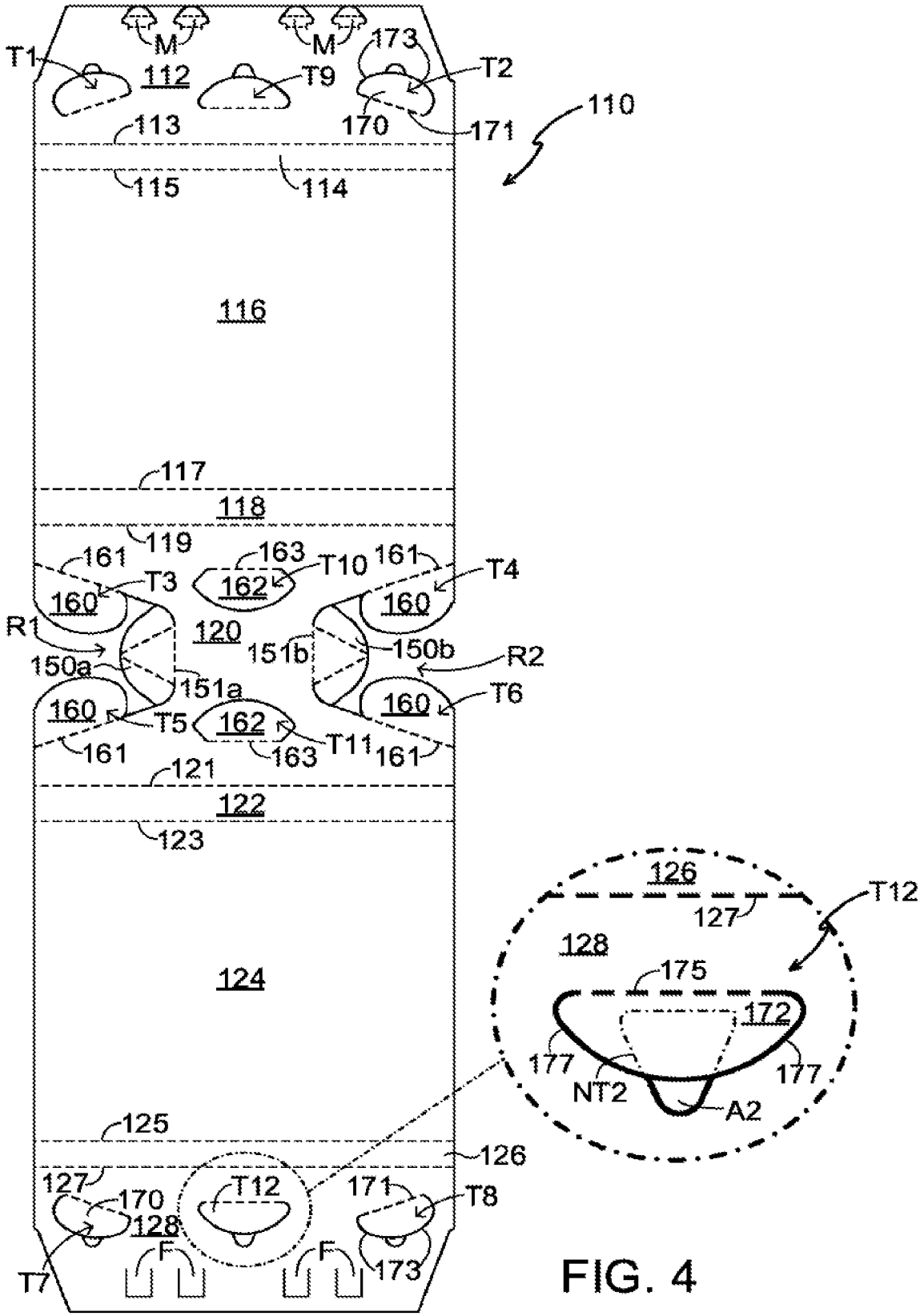
FIG. 4 is a plan view from above of a blank for forming an article carrier according to further embodiments of the disclosure.
Figure 5:
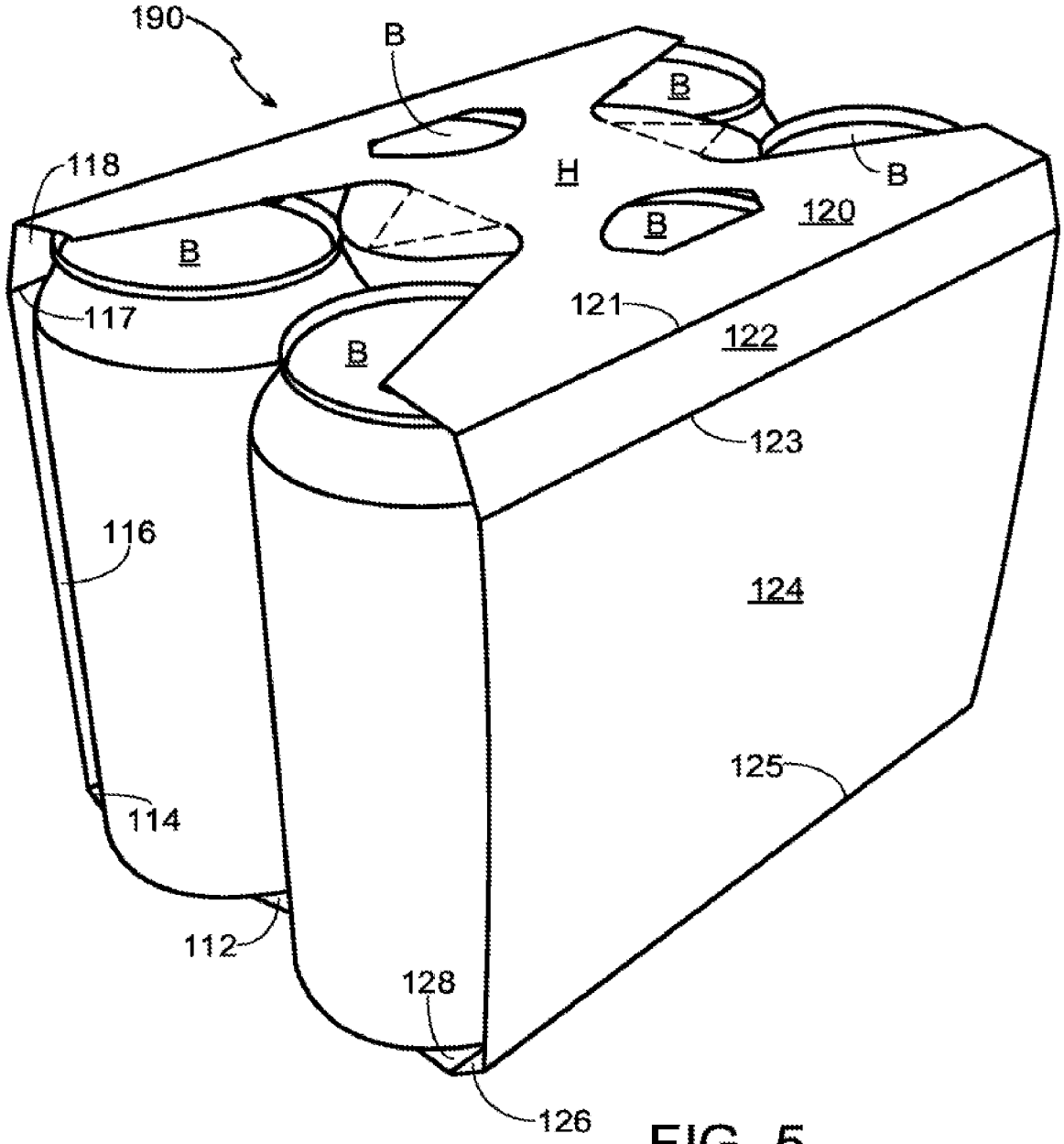
FIG. 5 is a perspective view of an article carrier formed from the blank of FIG. 1.

Referring to FIG. 4, there is shown a plan view of another blank 110 capable of forming a carton or carrier 190, as shown in FIG. 5, for containing and carrying a group of primary products such as, but not limited to, beverage cans. The blank 110 can be assembled to form a secondary package for packaging at least one primary product container or package.

Figure 6:
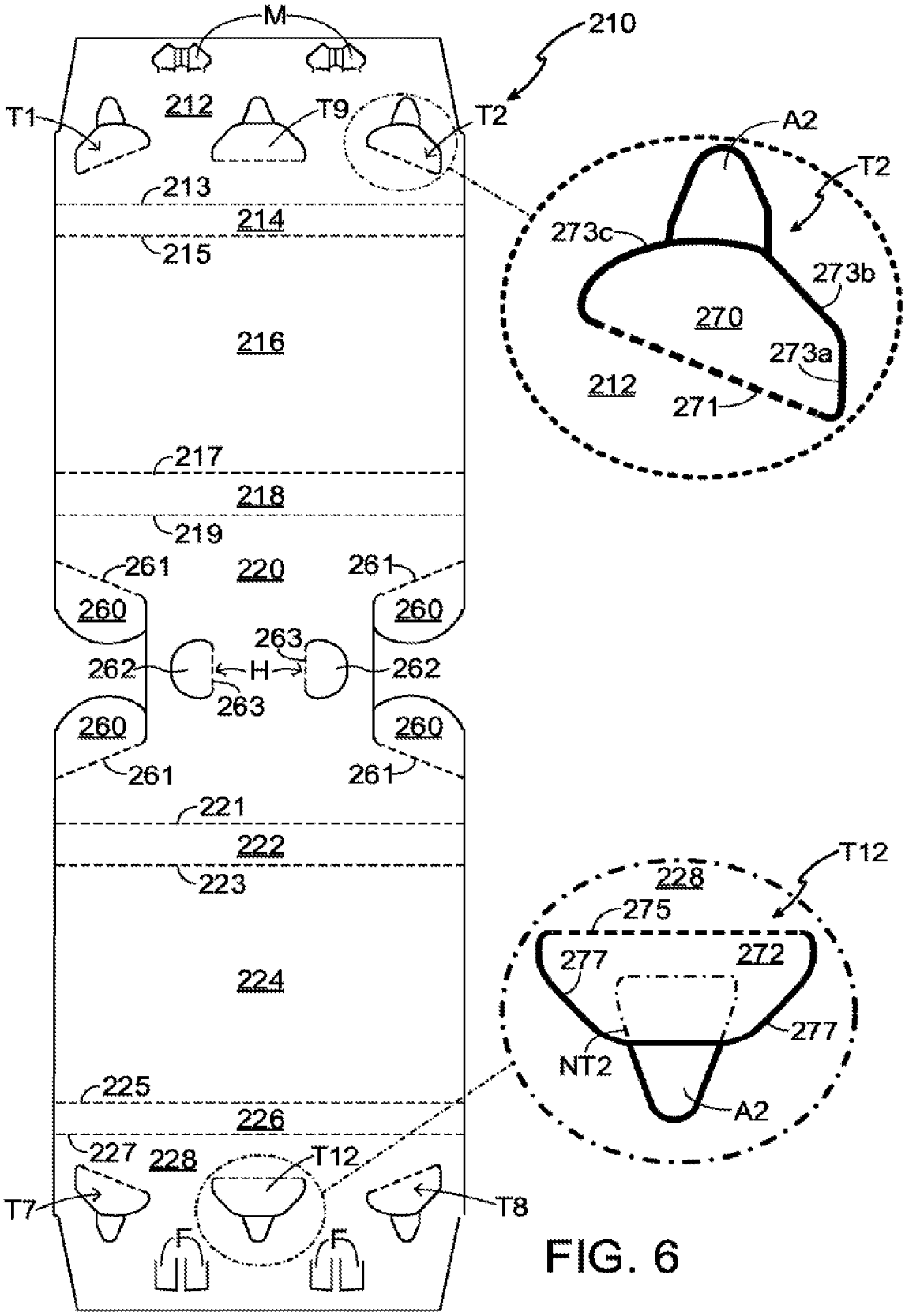
FIG. 6 is a plan view from above of a blank for forming an article carrier according to still further embodiments of the disclosure.
Figure 8:
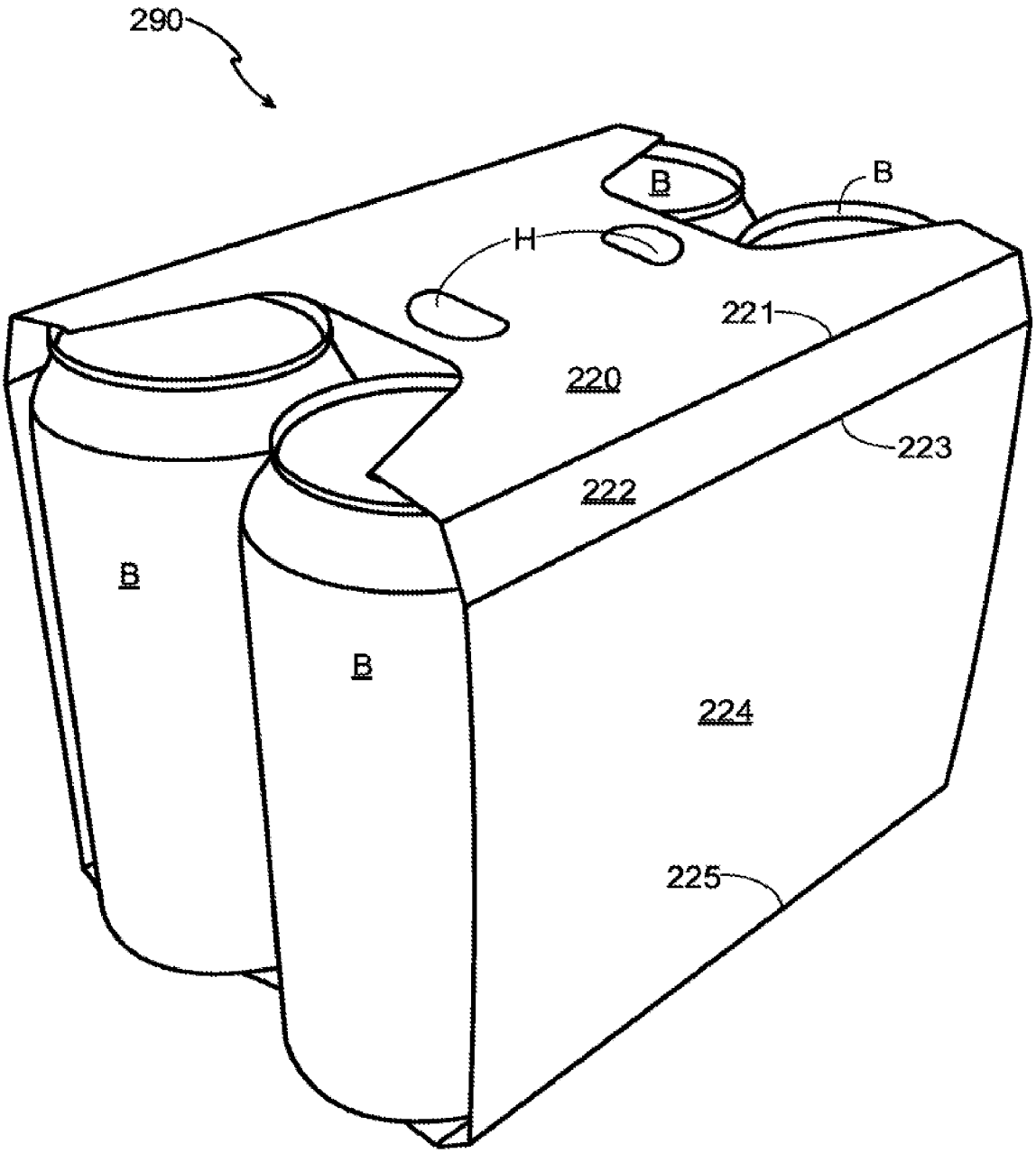
FIG. 8 is a perspective view of an article carrier formed from the blank of FIG. 6.
Figure 9:
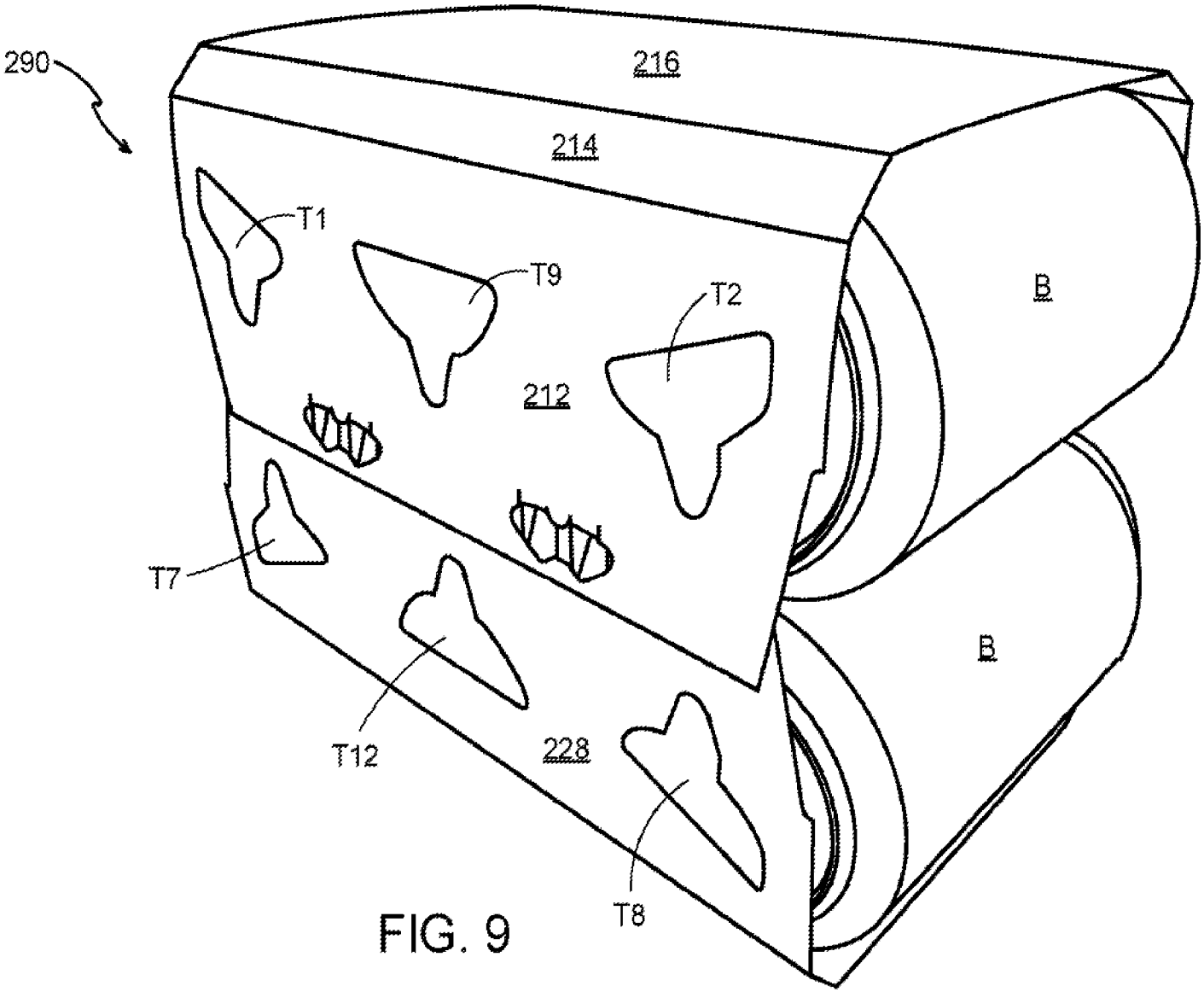
FIG. 9 is a perspective view from below of the article carrier of FIG. 8.

Referring to FIG. 6, there is shown a plan view of a third blank 210 capable of forming a carton or carrier 290, as shown in FIG. 8, for containing and carrying a group of primary products such as, but not limited to, beverage cans. The blank 210 can be assembled to form a secondary package for packaging at least one primary product container or package.

In the embodiments detailed herein, the terms "carton" and "carrier" refer, for the non-limiting purpose of illustrating the various features of the invention, to a container 90; 190; 290 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, cups, pots, pouches, packets and the like. The articles may comprise a recess or indentation in the upper and/or lower ends thereof. In some embodiments the articles may comprise a projection or flange extending outwardly, upwardly or downwardly so as to provide a wall or engaging surface.

The blanks 10; 110; 210 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or carton 90; 190; 290 described herein may be formed from a sheet material such as paperboard, which may be made of or coated with materials to increase its strength. An example of such a sheet material is tear-resistant NATRALOCK® paperboard made by WestRock Company. It should be noted that the tear-resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 3:
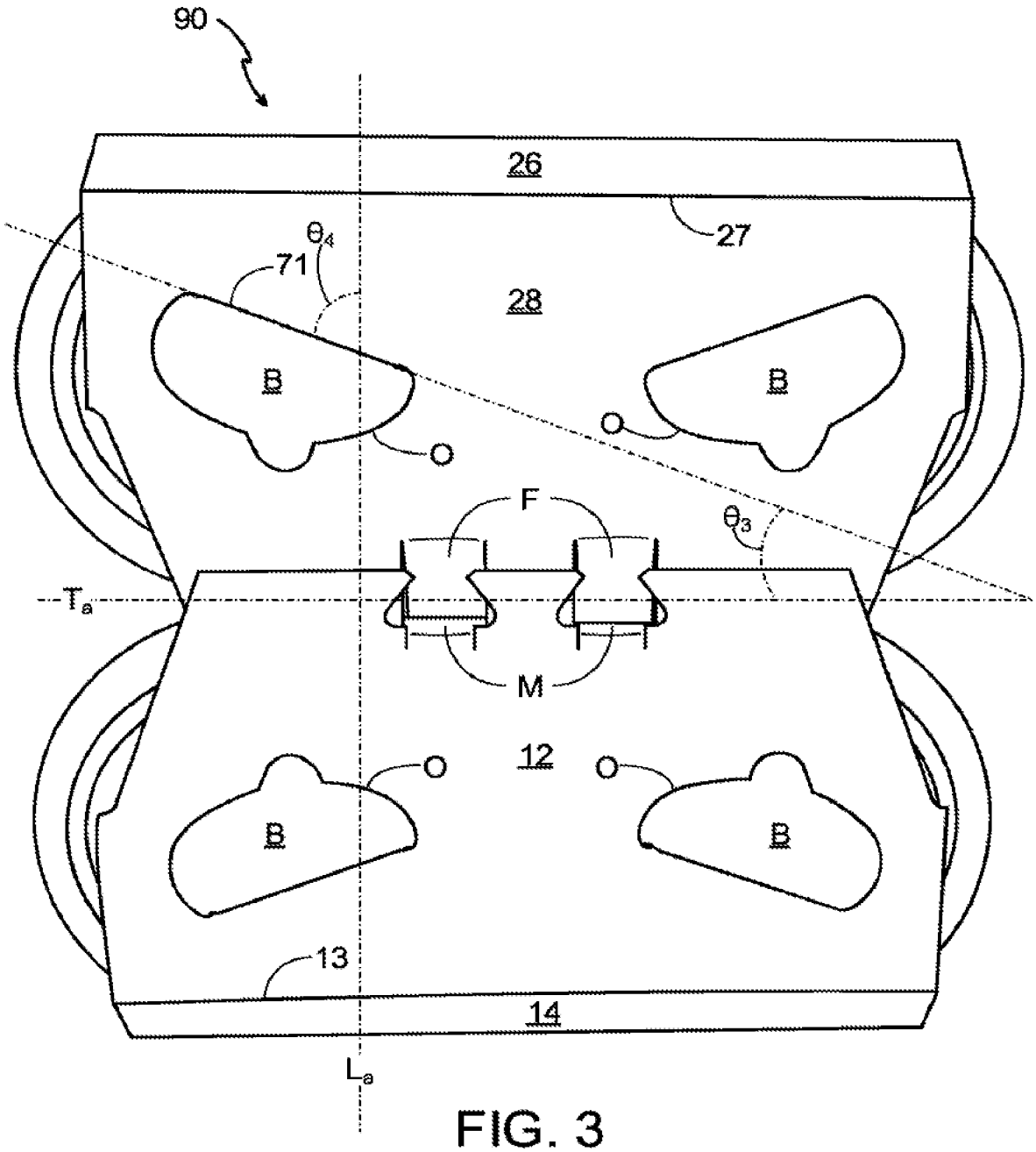
FIG. 3 is a perspective view from below of the article carrier of FIG. 2.

In the embodiments illustrated in FIGS. 1 to 3, the blank 10 is configured to form a carton or carrier 90 for packaging an exemplary arrangement of exemplary articles B. In the illustrated embodiments the arrangement is an m×n matrix or array, having two rows (m=2) and two columns (n=2); in the illustrated embodiments two rows of two articles B are provided, and the articles B are 500 ml beverage cans.

In the embodiments illustrated in FIGS. 4 and 5, the blank 110 is configured to form a carton or carrier 190 for packaging an exemplary arrangement of exemplary articles B. In the illustrated embodiments the arrangement is an m×n matrix or array, having two rows (m=2) and three columns (n=3); in the illustrated embodiments two rows of three articles B are provided, and the articles B are 500 ml beverage cans.

In the embodiments illustrated in FIGS. 6 to 9, the blank 210 is configured to form a carton or carrier 290 for packaging an exemplary arrangement of exemplary articles B. In the illustrated embodiments the arrangement is an m×n matrix or array, having two rows (m=2) and three columns (n=3); in the illustrated embodiments two rows of three articles B are provided, and the articles B are 330 ml beverage cans.

Alternatively, the blanks 10; 110; 210 can be configured to form a carrier for packaging other types, number and sizes of articles B and/or for packaging articles B in a different arrangement or configuration for example, but not limited to, fully enclosed cartons or basket carriers, and the articles B may be bottles or cans.

Turning to FIG. 1, there is illustrated a blank 10 for forming an article carrier 90 (see FIG. 2) according to certain embodiments of the disclosure. The blank 10 comprises a plurality of main panels 12, 14, 16, 18, 20, 22, 24, 26, 28 for forming a tubular structure. The plurality of main panels 12, 14, 16, 18, 20, 22, 24, 26, 28 comprises: a first base panel 12, a first corner or bevel panel 14, a first side panel 16, a second corner or bevel panel 18, a top panel 20, a third corner or bevel panel 22, a second side panel 24, a fourth corner or bevel panel 26 and a second base panel 28. The plurality of panels 12, 14, 16, 18, 20, 22, 24, 26, 28 may be arranged in a linear series hinged one to the next by corresponding fold lines 13, 15, 17, 19, 21, 23, 25, 27.

In alternative embodiments, the first, second, third and fourth corner panels 14, 18, 22, 26 may be omitted.

Fold line 13 and fold line 27 optionally comprise cut lines or severance lines (not shown) which are collinear with the respective one of fold line 13 and fold line 27 so as to interrupt said fold line 13, 27 or be coincident therewith. Severance lines may provide shock absorbing or damping devices proximate the base of the carton 90.

The first and fourth corner panels 14, 26 are optional and may be considered to form lower portions of the respective one of the first or second side panels 16, 24, or alternatively form part of the first or second base panels 12, 28, to which they are hingedly connected. In some embodiments the first and fourth corner panels 14, 26 may be omitted, and the fold lines 15, 25 may be omitted in such embodiments.

The second and third corner panels 18, 22 are optional and may be considered to form upper portions of the respective one of the first or second side panels 16, 24, or alternatively form part of the top panel 20. In some embodiments the second and third corner panels 18, 22 may be omitted, and the fold lines 17, 23 may be omitted in such embodiments.

The blank 10 is foldable to form a package 90 as illustrated in FIGS. 2 and 3. The first and second base panels 12, 28 are engageable with one another in an overlapping relationship to form a composite base wall 12/28 of the carton 90. The blank 10 may comprise a complementary locking mechanism for securing the second base panel 28 to the first base panel 12. The second base panel 28 may comprise at least one first part F of the complementary locking mechanism. The first base panel 12 may comprise at least one second part M of the complementary locking mechanism. In the illustrated embodiment, the second base panel 28 comprises a plurality of female tabs F defining openings in the second base panel 28. The first base panel 12 comprises a plurality of male tabs M; and the openings in the second base panel 28 are configured to receive a respective one of the male tabs M. The female tabs F are arranged to be displaced out of the second base panel 28 to form the opening and to bear against the male tabs M when received therein. In some embodiments the complementary locking mechanism M/F may be omitted; and the first and second base panels 12, 28 may be secured to each other by other means such as but not limited to adhesive or staples.

The complementary locking mechanism illustrated and described is entirely optional.

The blank 10 comprises at least one article retention device or article engagement structure T1, T2, T3, T4, T5, T6, T7, T8.

The blank 10 comprises at least one first article retention device (also referred to herein as upper end article retention devices or article engagement structures) T3, T4, T5, T6 for engaging an upper end of the articles B. The blank 10 illustrated in FIG. 1 comprises four first article engagement structures T3, T4, T5, T6.

The blank 10 comprises at least one second article retention device (also referred to herein as lower end article retention devices or article engagement structures) T1, T2, T7, T8 for engaging a lower end of the articles B. The blank 10 illustrated in FIG. 1 comprises four second article engagement structures T1, T2, T7, T8.

Each of the first article engagement structures T3, T4, T5, T6 comprises a flap 60 hingedly connected to the top panel 20. A first and a second one of the first article engagement structures T3, T5 each comprise a flap 60 hingedly connected to the top panel 20 to a first end of the top panel 20. A third and a fourth one of the first article engagement structures T4, T6 each comprise a flap 60 hingedly connected to the top panel 20 to a second end of the top panel 20.

The flaps 60 of the first and second first article engagement structures T3, T5 extend to a first outer edge of the blank 10.

The flaps 60 of the third and fourth first article engagement structures T4, T6 extend to a second outer edge of the blank 10.

The flaps 60 of the first article engagement structures T3, T4, T5, T6 do not extend beyond the footprint of the top panel 20. The flaps 60 of the first article engagement structures T3, T4, T5, T6 are contained entirely within the footprint of the top panel 20.

The flaps 60 do not extend beyond the ends of the top panel 20.

Marginal portions of the top panel 20 hingedly connected to each of the first and second side panels 16, 24, or second and third bevel panels 18, 22 when present, are equal in length to the first and second side panel 16, 24 (or second and third bevel panels 18, 22).

A first recess R1 is provided in the first end of the top panel 20, the flaps 60 of the first and second first article engagement structures T3, T5 can be considered to be located in the first recess R1. The flaps 60 of the first and second first article engagement structures T3, T5 may define at least in part the first recess R1 and when folded out of the plane of the top panel 20, increase the size of the first recess R1.

The first recess R1 is arranged to accommodate the entirety of the flaps 60.

The first recess R1 is defined in the top panel 20 and does not extend into the first and second side panels 16, 24 or second and third bevel panels 18, 22.

The flap 60 of the first one of the first article engagement structures T3 is hingedly connected to the top panel 20 by a hinged connection in the form of a fold line 61 which is obliquely oriented with respect to the fold line 19 hinging the top panel 20 to the second corner panel 18. The fold line 61 is spaced apart from a first end edge of one of the marginal portions of the top panel 20.

The flap 60 of the second one of the first article engagement structures T5 is hingedly connected to the top panel 20 by a hinged connection in the form of a fold line 61 which is obliquely oriented with respect to the fold line 21 hinging the top panel 20 to the third corner panel 22. The fold line 61 is spaced apart from a first end edge of the other one of the marginal portions of the top panel 20.

The fold line 61 hinging the flap 60 of the first one of the first article engagement structures T3 to the top panel 20 is divergently arranged with respect to the fold line 61 hinging the flap 60 of the second one of the first article engagement structures T5 to the top panel 20. The fold line 61 hinging the flap 60 of the first one of the first article engagement structures T3 to the top panel 20 and the fold line 61 hinging the flap 60 of the second one of the first article engagement structures T5 to the top panel 20 define an angle therebetween; the angle may be less than 60° and in some embodiments may be around 40°. The angle may be greater than 20° and may be greater than 30°.

The fold line 61 hinging the flap 60 of the first one of the first article engagement structures T3 to the top panel 20 and the fold line 51 hinging the flap 60 of the second one of the first article engagement structures T5 to the top panel 20 are arranged to diverge towards the first end of the top panel 20.

The fold line 61 hinging the flap 60 of the first one of the first article engagement structures T3 to the top panel 20 and the fold line 61 hinging the flap 60 of the second one of the first article engagement structures T5 to the top panel 20 are arranged to converge towards the second end of the top panel 20.

In this way the flap 60 of the first one of the first article engagement structures T3 and the flap 60 of the second one of the first article engagement structures T5 fold away from each other.

A second recess R2 is provided in the second end of the top panel 20, the flaps 60 of the third and fourth first article engagement structures T4, T6 can be considered to be located in the second recess R2. The flaps 60 of the third and fourth first article engagement structures T4, T6 may define at least in part the second recess R2 and when folded out of the plane of the top panel 20, increase the size of the second recess R2.

The second recess R2 is defined in the top panel 20 and does not extend into the first and second side panels 16, 24 or second and third bevel panels 18, 22.

The second recess R2 is arranged to accommodate the entirety of the flaps 60.

The flap 60 of the third one of the first article engagement structures T4 is hingedly connected to the top panel 20 by a hinged connection in the form of a fold line 61 which is obliquely oriented with respect to the fold line 19 hinging the top panel 20 to the second corner panel 18. The fold line 61 is spaced apart from a second end edge of said one of the marginal portions of the top panel 20.

The flap 60 of the fourth one of the first article engagement structures T6 is hingedly connected to the top panel 20 by a hinged connection in the form of a fold line 61 which is obliquely oriented with respect to the fold line 21 hinging the top panel 20 to the third corner panel 22. The fold line 61 is spaced apart from a second end edge of said other one of the marginal portions of the top panel 20.

The fold line 61 hinging the flap 60 of the third one of the first article engagement structures T4 to the top panel 20 is divergently arranged with respect to the fold line 61 hinging the flap 60 of the fourth one of the first article engagement structures T6 to the top panel 20.

The fold line 61 hinging the flap 60 of the third one of the first article engagement structures T3 to the top panel 20 is divergently arranged with respect to the fold line 19 hinging the first side panel 16 (or second corner panel 18 when present) to the top panel 20. The fold line 61 hinging the flap 60 of the third one of the first article engagement structures T3 and the fold line 19 define a first angle $\theta_1$ therebetween. The fold line 61 hinging the flap 60 of the third one of the first article engagement structures T3 defines a second angle $\theta_2$ with respect to a longitudinal axis $L_a$ of the blank 10.

The first angle $\theta_1$ may be acute. The first angle $\theta_1$ may be less than or equal to 50°. The first angle $\theta_1$ may be less than or equal to 30°. The first angle $\theta_1$ may be around 20°. The first angle $\theta_1$ may be greater than or equal to 10°.

The second angle $\theta_2$ may be acute. The second angle $\theta_2$ may be greater than or equal to 40° and less than 90°.

The fold line 61 hinging the flap 60 of the third one of the first article engagement structures T3 to the top panel 20 is divergently arranged with respect to the fold line 61 hinging the flap 60 of the second one of the first article engagement structures T5 to the top panel 20. The fold line 61 hinging the flap 60 of the first one of the first article engagement structures T3 to the top panel 20 and the fold line 61 hinging the flap 60 of the second one of the first article engagement structures T5 to the top panel 20 define an angle therebetween; the angle may be less than 60° and in some embodiments may be around 40°. The angle may be greater than 20° and may be greater than 30°.

The fold line 61 hinging the flap 60 of the third one of the first article engagement structures T4 to the top panel 20 and the fold line 41 hinging the flap 40 of the fourth one of the first article engagement structures T6 to the top panel 20 are arranged to diverge towards the second end of the top panel 20.

The fold line 61 hinging the flap 60 of the third one of the first article engagement structures T4 to the top panel 20 and the fold line 61 hinging the flap 60 of the fourth one of the first article engagement structures T6 to the top panel 20 are arranged to converge towards the first end of the top panel 20.

In the blank form the flaps 60 define in part free end edges of the top panel 20.

The inner ends of the first article engagement structures T3, T4, T5, T6 may be separated from the top panel 20 by cut lines 63. The cut lines 63 may be curvilinear or arcuate. The cut lines 63 may terminate in a "J" or "C" shaped section. The fold lines 61 extend from the curved ends of the cut lines 63.

Each of the second article engagement structures T1, T2, T7, T8 comprises a flap 70 hingedly connected to one of the first and second base panels 12, 28 by a fold line 71. A first and a second one of the second article engagement structures T1, T2 each comprise a flap 70 hingedly connected to the first base panel 12. A third and a fourth one of the second article engagement structures T7, T8 each comprise a flap 70 hingedly connected to the second base panel 28.

The fold line 71 hinging the flaps 70 of the second article engagement structures T1, T2, T7, T8 to the first and second base panels 12, 28 is divergently arranged with respect to a respective one of the fold lines 13, 27. The fold line 71 hinging the flap 70 of the second article engagement structures T1, T2, T7, T8 and the respective one of the fold lines 13, 27 defines a third angle $\theta_3$ therebetween. The fold line 71 hinging the flap 70 of the second article engagement structures T1, T2, T7, T8 defines a fourth angle $\theta_4$ with respect to a longitudinal axis $L_a$ of the blank 10.

The third angle $\theta_3$ may be acute. The third angle $\theta_3$ may be less than or equal to 50°. The third angle $\theta_3$ may be less than or equal to 30°. The third angle $\theta_3$ may be around 20°. The third angle $\theta_3$ may be greater than or equal to 10°. The third angle $\theta_3$ may be equal to the first angle $\theta_1$.

The fourth angle $\theta_4$ may be acute. The fourth angle $\theta_4$ may be greater than or equal to 40° and less than 90°. The fourth angle $\theta_4$ may be equal to the second angle $\theta_2$.

Each of the second article engagement structures T1, T2, T7, T8 may comprise an assembly device. The assembly device facilitates tightening of the blank 10 about the group of articles B. The assembly device may comprise an alignment feature. The assembly device takes the form of an opening in the first or second base panels 12, 28. The opening (also referred to herein as a machine pull opening) is defined at least in part by the tab 70 of the second article engagement structures T1, T2, T7, T8. The alignment feature takes the form of a cutaway A1, the cutaway A1 in the blank 10 forms an aperture adjacent to and contiguous with the tab 70. In an operative condition the cutaway A1 forms a recess or notch extending from the opening created in the first or second base panels 12, 28 formed when the tab 70 is folded internally of the carrier 90. In this way the opening created in the first or second base panels 12, 28 by the tab 70 and the cutaway A1 are integral or combine to form a single aperture. The cutaway A1 is defined by a part of a notional triangle NT, another part of which is accommodated within the tab 70. One of the vertices of the triangle is disposed outside footprint of the tab 70 such that the cutaway A1 is formed.

In the illustrated embodiment the side of the triangle opposing the vertex disposed outside the tab 70 is non parallel with the fold line 71 hinging the tab 70 to the first or second base panels 12, 28; said side of the triangle and the fold line 71 define an angle therebetween, said angle may be equal to the third angle $\theta_3$.

Each of the tabs 70 of the second article engagement structures T1, T2, T7, T8 is defined by a cut line 73, terminal ends of the cut line 73 are arcuate or curved in shape. The fold line 71 extends between the curved ends of the cut line 73. The cut line 73 is interrupted by the cutaway A1 to form two cut line portions.

Optionally, the blank 10 comprises a handle structure H, the handle structure H may take the form of a handle strap extending transversely, between the first and second side panels 16, 24, across the carrier 90. The handle strap may be defined in part by the first and second recesses R1, R2.

The handle structure H may comprise a pair of cushioning flaps 50*a*, 50*b* disposed on opposing side of the handle strap and hingedly connected thereto by hinged connections in the form of fold lines 51*a*, 51*b*. The cushioning flaps 50*a*, 50*b* may be defined in part by the first or second recess R1, R2. The cushioning flaps 50*a*, 50*b* may extend or enlarge the respective one of the first and second recesses R1, R2. The cushioning flaps 50*a*, 50*b* may extend between pairs of the first article engagement structures T3, T4, T5, T6 and may be separated therefrom by cut lines. A first cushioning flap 50*a* extends between the first and second first article engagement structures T3, T5. A second cushioning flap 50*a* extends between the third and fourth first article engagement structures T4, T6.

Referring now to FIG. 4, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 3 will be described in detail.

FIG. 4 illustrates a blank 110 for forming an article carrier 190, as shown in FIG. 5, according to another embodiment of the disclosure. The blank 110 comprises a plurality of main panels 112, 114, 116, 118, 120, 122, 124, 126, 128 for forming a tubular structure. The plurality of main panels 112, 114, 116, 118, 120, 122, 124, 126, 128 comprises: a first base panel 112, an optional first corner or bevel panel 114, a first side panel 116, an optional second corner or bevel panel 118, a top panel 120, an optional third corner or bevel panel 122, a second side panel 124, an optional fourth corner or bevel panel 126 and a second base panel 128. The plurality of panels 112, 114, 116, 118, 120, 122, 124, 126, 128 may be arranged in a linear series hinged one to the next by corresponding fold lines 113, 115, 117, 119, 121, 123, 125, 127.

The blank 110 of FIG. 4 is adapted to accommodate six articles B.

The blank 110 comprises at least one outer or end article retention device or article engagement structure T3, T4, T5, T6 for engaging an upper end of the outer or endmost disposed articles B. The blank 110 illustrated in FIG. 4 comprises four end article engagement structures T3, T4, T5, T6.

Each of the outer article engagement structures T3, T4, T5, T6 comprises a flap 160 hingedly connected to the top panel 120. A first and a second one of the first article engagement structures T3, T5 each comprise a flap 160 hingedly connected to the top panel 120 to a first end of the top panel 120. A third and a fourth one of the first article engagement structures T4, T6 each comprise a flap 160 hingedly connected to the top panel 120 to a second end of the top panel 120.

The flaps 160 of the outer article engagement structures T3, T4, T5, T6 do not extend beyond the footprint of the top panel 120. The flaps 160 of the outer article engagement structures T3, T4, T5, T6 are contained entirely within the footprint of the top panel 120.

The flaps 160 do not extend beyond the ends of the top panel 120.

The flaps 160 of the outer article engagement structures T3, T4, T5, T6 do not extend beyond edges of the blank 110 defined, at least in part, by the first and second side panels 116, 124.

A first recess R1 is provided in the first end of the top panel 120, the flaps 160 of the first and second outer article engagement structures T3, T5 can be considered to be located in the first recess R1. The flaps 160 of the first and second outer article engagement structures T3, T5 define in part the first recess R1 and when folded out of the plane of the top panel 120 increase the size of the first recess R1.

The first recess R1 is arranged to accommodate the entirety of the flaps 160.

The first recess R1 is defined in the top panel 120 and does not extend into the first and second side panels 116, 124 or second and third bevel panels 118, 122.

The flap 160 of the first one of the outer article engagement structures T3 is hingedly connected to the top panel 120 by a hinged connection in the form of a fold line 161 which is obliquely oriented with respect to the fold line 119 hinging the top panel 120 to the second corner panel 118. The fold line 161 is spaced apart from a first end edge of one of the marginal portions of the top panel 120.

The flap 160 of the second one of the outer article engagement structures T5 is hingedly connected to the top panel 120 by a hinged connection in the form of a fold line 161 which is obliquely oriented with respect to the fold line 121 hinging the top panel 120 to the third corner panel 122. The fold line 161 is spaced apart from a first end edge of the other one of the marginal portions of the top panel 120.

The fold line 161 hinging the flap 160 of the first one of the outer article engagement structures T3 to the top panel 120 is divergently arranged with respect to the fold line 161 hinging the flap 160 of the second one of the outer article engagement structures T5 to the top panel 120. The fold line 161 hinging the flap 160 of the first one of the outer article engagement structures T3 to the top panel 120 and the fold line 161 hinging the flap 160 of the second one of the outer article engagement structures T5 to the top panel 120 define an angle therebetween the angle may be less than 50° and in some embodiments may be around 40°.

The fold line 161 hinging the flap 160 of the first one of the outer article engagement structures T3 to the top panel 120 and the fold line 161 hinging the flap 160 of the second one of the outer article engagement structures T5 to the top panel 120 are arranged to diverge towards the first end of the top panel 120.

The fold line 161 hinging the flap 160 of the first one of the outer article engagement structures T1 to the top panel 120 and the fold line 161 hinging the flap 160 of the second one of the outer article engagement structures T5 to the top panel 120 are arranged to converge towards the centre or middle of the top panel 120.

In this way the flap 160 of the first one of the outer article engagement structures T3 and the flap 160 of the second one of the outer article engagement structures T5 fold away from each other.

A second recess R2 is provided in the second end of the top panel 120, the flaps 160 of the third and fourth outer article engagement structures T4, T6 can be considered to be located in the second recess R2. The flaps 160 of the third and fourth outer article engagement structures T4, T6 define in part the second recess R2 and when folded out of the plane of the top panel 120 increase the size of the second recess R2.

The second recess R2 is defined in the top panel 120 and does not extend into the first and second side panels 116, 124 or second and third bevel panels 118, 122.

The second recess R2 is arranged to accommodate the entirety of the flaps 160.

The flap 160 of the third one of the outer article engagement structures T4 is hingedly connected to the top panel 120 by a hinged connection in the form of a fold line 161 which is obliquely oriented with respect to the fold line 119 hinging the top panel 120 to the second corner panel 118. The fold line 161 is spaced apart from a second end edge of said one of the marginal portions of the top panel 120.

The flap 160 of the fourth one of the outer article engagement structures T6 is hingedly connected to the top panel 120 by a hinged connection in the form of a fold line 161 which is obliquely oriented with respect to the fold line 121 hinging the top panel 120 to the third corner panel 122. The fold line 161 is spaced apart from a second end edge of said other one of the marginal portions of the top panel 120.

The fold line 161 hinging the flap 160 of the third one of the outer article engagement structures T4 to the top panel 120 is divergently arranged with respect to the fold line 161 hinging the flap 160 of the fourth one of the outer article engagement structures T6 to the top panel 120.

The fold line 161 hinging the flap 160 of the third one of the outer article engagement structures T4 to the top panel 20 and the fold line 161 hinging the flap 160 of the fourth one of the first article engagement structures T6 to the top panel 120 are arranged to diverge towards the first end of the top panel 120.

The fold line 161 hinging the flap 160 of the third one of the outer article engagement structures T4 to the top panel 120 and the fold line 161 hinging the flap 160 of the fourth one of the outer article engagement structures T6 to the top panel 120 are arranged to converge towards the centre or middle of the top panel 120.

The blank 110 may comprise at least one inner or intermediate article retention device or article engagement structure T10, T11 for engaging an upper end of intermediate or centrally disposed the articles B. The blank 110 illustrated in FIG. 4 comprises two inner article engagement structures T10, T11.

Each of the inner article engagement structures T10, T11 comprises a flap 162 hingedly connected to the top panel 120.

The flap 162 of the first one of the inner article engagement structures T10 is hingedly connected to the top panel 120 by a hinged connection in the form of a fold line 163 which is oriented parallel with respect to the fold line 129 hinging the top panel 220 to the second corner panel 128.

The fold line 163 of the first one of the inner article engagement structures T10 defines a hinged edge of the flap 162, in the unfolded condition the hinged edge is disposed closer to the fold line 119 than a free edge defined by a cut or severance line. In the folded, operable, condition the free edge of the flap 162 is disposed closer to the first side panel 116 than the hinged edge defined by the fold line 163.

The flap 162 of the second one of the inner article engagement structures T11 is hingedly connected to the top panel 120 by a hinged connection in the form of a fold line 163 which is oriented parallel with respect to the fold line 121 hinging the top panel 120 to the third corner panel 122.

The fold line 163 of the second one of the inner article engagement structures T11 defines a hinged edge of the flap 162, in the unfolded condition the hinged edge is disposed closer to the fold line 121 than a free edge defined by a cut or severance line. In the folded, operable, condition the free edge of the flap 162 is disposed closer to the second side panel 116 than the hinged edge defined by the fold line 163.

The fold line 163 hinging the flap 163 of the first one of the inner article engagement structures T10 to the top panel 120 is arranged parallel with respect to the fold line 163 hinging the flap 162 of the second one of the inner article engagement structures T11 to the top panel 120.

The blank 110 comprises at least one second outer or end article retention device or article engagement structure T1, T2, T7, T8 for engaging a lower end of the outer or endmost disposed articles B. The blank 110 illustrated in FIG. 4 comprises four end article engagement structures T1, T2, T7, T8. The second outer or end article retention devices of the embodiment shown in FIG. 4 are substantially similar in construction to the second article retention devices T1, T2, T7, T8 of the embodiment shown in FIG. 1.

The blank 110 may comprise at least one second inner or intermediate article retention device or article engagement structure T9, T12 for engaging a lower end of intermediate or centrally disposed the articles B. The blank 110 illustrated in FIG. 4 comprises two second inner article engagement structures T9, T12.

Each of the second intermediate article engagement structures T9, T12 comprises a flap 172 hingedly connected to one of the first and second base panels 112, 128 by a fold line 175. A first one of the second article engagement structures T9 comprises a flap 170 hingedly connected to the first base panel 112. A second one of the second intermediate article engagement structures T12 comprises a flap 170 hingedly connected to the second base panel 128.

The fold line 175 hinging the flaps 172 of the second intermediate article engagement structures T9, T12 to the first and second base panels 112, 128 is arranged substantially parallel with respect to a respective one of the fold lines 113, 127.

Each of the second intermediate article engagement structures T9, T12 may comprise an assembly device. The assembly device facilitates tightening of the blank 110 about the group of articles B. The assembly device may comprise an alignment feature. The assembly device takes the form of an opening in the first or second base panels 112, 128. The opening (also referred to herein as a machine pull opening) is defined in part by the tab 172 of the second intermediate article engagement structures T9, T12. The alignment feature takes the form of a cutaway A2, the cutaway A2 in the blank 110 forms an aperture adjacent to and contiguous with the tab 172. In an operative condition the cutaway A2 forms a recess or notch extending from the opening created in the first or second base panels 112, 128 formed when the tab 172 is folded internally of the carrier 190. In this way the opening created in the first or second base panels 112, 128 by the tab 172 and the cutaway A2 are integral or combine to form a single aperture. The cutaway A2 is defined by a part of a notional triangle NT2, another part of which is accommodated within the tab 172. One of the vertices of the triangle is disposed outside footprint of the tab 172 such that the cutaway A2 is formed.

In the illustrated embodiment the side of the triangle opposing the vertex disposed outside the tab 172 is parallel with the fold line 175 hinging the tab 172 to the first or second base panels 112, 128.

Each of the tabs 172 second intermediate article engagement structures T9, T12 is defined by a cut line 177, terminal ends of the cut line 177 are arcuate or curved in shape. The fold line 175 extends between the curved ends of the cut line 177. The cut line 177 is interrupted by the cutaway A2 to form two cut line portions.

Optionally, the blank 110 comprises a handle structure H, the handle structure H may take the form of a handle strap extending transversely, between the first and second side panels 116, 124, across the carrier 190. The handle strap may be defined in part by the first and second recesses R1, R2.

The handle structure H may comprise a pair of cushioning flaps 50*a*, 50*b* disposed on opposing side of the handle strap and hingedly connected thereto by hinged connections in the form of fold lines 151*a*, 151*b*.

A first cushioning flap 150*a* may be spaced apart from the flaps 170 of the first and second the outer article engagement structures T3, T5.

A second cushioning flap 150*b* may be spaced apart from the flaps 170 of the third and fourth the outer article engagement structures T4, T6.

Referring now to FIG. 6, there is shown an additional embodiment of the present disclosure. In the third illustrated embodiment like numerals have, where possible, been used to denote like parts, albeit with the addition of the prefix "200" to indicate that these features belong to the third embodiment. The additional embodiment shares many common features with the first and second embodiments and therefore only the differences from the embodiments illustrated in FIGS. 1 to will be described in detail.

FIG. 6 illustrates a blank 210 for forming an article carrier 290, as shown in FIG. 8, according to another embodiment of the disclosure. The blank 210 comprises a plurality of main panels 212, 214, 216, 218, 220, 222, 224, 226, 228 for forming a tubular structure. The plurality of main panels 212, 214, 216, 218, 220, 222, 224, 226, 228 comprises: a first base panel 212, an optional first corner or bevel panel 214, a first side panel 216, an optional second corner or bevel panel 218, a top panel 220, an optional third corner or bevel panel 222, a second side panel 224, an optional fourth corner or bevel panel 226 and a second base panel 228. The plurality of panels 212, 214, 216, 218, 220, 222, 224, 226, 228 may be arranged in a linear series hinged one to the next by corresponding fold lines 213, 215, 217, 219, 221, 223, 225, 227.

The blank 210 comprises at least one outer or end article retention device (or article engagement structure) T3, T4, T5, T6 for engaging an upper end of the outer or endmost disposed articles B. The blank 210 illustrated in FIG. 6 comprises four end article engagement structures T3, T4, T5, T6. The upper intermediate article retention devices of FIG. 4 have been omitted in the illustrated embodiment, but in other embodiments they may be included.

Optionally, the blank 210 comprises a handle structure H in the form of a pair of finger tabs 262, struck from the top panel 220 and hingedly connected thereto by a fold line 263. The finger tabs 262 are hinged in opposition to each other.

The blank 210 comprises at least one second outer or end article retention device (or article engagement structure) T1, T2, T7, T8 for engaging a lower end of the outer or endmost disposed articles B. The blank 210 illustrated in FIG. 6 comprises four end article engagement structures T1, T2, T7, T8.

The second outer or end article retention devices T1, T2, T7, T8 of the embodiment shown in FIG. 6 each comprise a flap 270 hingedly connected to one of the first and second base panels 212, 228 by a fold line 271. A first and a second one of the second article engagement structures T1, T2 each comprise a flap 270 hingedly connected to the first base panel 212. A third and a fourth one of the second article engagement structures T7, T8 each comprise a flap 270 hingedly connected to the second base panel 228.

The fold line 271 hinging the flaps 270 of the second article engagement structures T1, T2, T7, T8 to the first and second base panels 212, 228 is divergently arranged with respect to a respective one of the fold lines 213, 227. The fold line 271 hinging the flap 270 of the second end article engagement structures T1, T2, T7, T8 defines an angle with respect to a longitudinal axis of the blank 210.

Each of the second end article engagement structures T1, T2, T7, T8 may comprise an assembly device. The assembly device facilitates tightening of the blank 210 about the group of articles B. The assembly device may comprise an alignment feature. The assembly device takes the form of an opening in the first or second base panels 212, 228. The opening (also referred to herein as a machine pull opening) is defined at least in part by the tab 270 of the second end article engagement structures T1, T2, T7, T8. The alignment feature takes the form of a cutaway A2, the cutaway A2 in the blank 210 forms an aperture adjacent to and contiguous with the tab 270. In an operative condition the cutaway A2 forms a recess or notch extending from the opening created in the first or second base panels 212, 228 formed when the tab 270 is folded internally of the carrier 290.

Each of the tabs 270 of the second end article engagement structures T1, T2, T7, T8 is defined by a cut line 273*a*/273*b*/273*c*. The cut line comprises a first portion 273*a*, a second portion 273*b* and a third portion 273*c*.

Terminal ends of the first and third portions 273*a*, 273*c* of the cut line 273*a*/273*b*/273*c*, adjacent to the fold line 271 are arcuate or curved in shape. The fold line 271 extends between the curved ends of the cut line 273*a*/273*b*/273*c*. The cut line 273*a*/273*b*/273*c* is interrupted by the cutaway A2 such that two of the cut line portions 273*a*, 273*b* are disposed on a first side of the cutaway A2 and the other cut line portion 277*c* is disposed on the opposing side of the cutaway A2.

At least one of the cut line portions 273*a*/273*b*/273*c* may be shaped to provide a relief. In the illustrated embodiment the second cut line portion 273*b* provides a relief.

The relief facilitates engagement of the tab 270 with the base of an article B. The relief may define a non-securing or non-engaging edge of the tab 270. In this way the portion of the tab 270 defined by the relief is freely or readily movable between an engaged condition and a disengaged condition with the article B.

The second cut line portion 273*b* may be arranged to be spaced apart from an engaging surface provided by the article B, the engaging surface may take the form of a wall provided by a recess, upstand or flange extending from, or into, the base of the article B. In this way the second cut line portion 273*b* may not contact the article B. This may have the effect of reducing friction between the tab 270 and the article B so as to may engagement of the tab 270 with the article easier by reducing the force that needs to be applied when compared with the first and second illustrated embodiments.

In the illustrated embodiment the second cut line portion 273*c* is substantially linear in shape, this has the effect of truncating the tab 270. It will be appreciated that the second cut line portion 273*c* may be other shapes and still have the effect of truncating the tab 270, for example, but not limited to, the second cut line portion 273*c* may be re-entrant or concave, it may be non-linear or arcuate (also referred to herein as concavely curved), it may comprise two or more contiguous linear sections divergently arranged with respect to each other (also referred to herein as concavely angled).

The blank 210 may comprise at least one second inner or intermediate article retention device or article engagement structure T9, T12 for engaging a lower end of intermediate or centrally disposed the articles B. The blank 210 illustrated in FIG. 6 comprises two second inner article engagement structures T9, T12.

Each of the second intermediate article engagement structures T9, T12 comprises a flap 272 hingedly connected to one of the first and second base panels 212, 228 by a fold line 275. A first one of the second intermediate article engagement structures T9 comprises a flap 272 hingedly connected to the first base panel 212. A second one of the second intermediate article engagement structures T12 comprises a flap 270 hingedly connected to the second base panel 228.

The fold line 275 hinging the flaps 272 of the second intermediate article engagement structures T9, T12 to the first and second base panels 212, 228 is arranged substantially parallel with respect to a respective one of the fold lines 213, 227.

Each of the second intermediate article engagement structures T9, T12 may comprise an assembly device. The assembly device facilitates tightening of the blank 210 about the group of articles B. The assembly device may comprise an alignment feature. The assembly device takes the form of an opening in the first or second base panels 212, 228. The opening (also referred to herein as a machine pull opening) is defined in part by the tab 272 of the second intermediate article engagement structures T9, T12. The alignment feature takes the form of a cutaway A2, the cutaway A2 in the blank 210 forms an aperture adjacent to and contiguous with the tab 272. In an operative condition the cutaway A2 forms a recess or notch extending from the opening created in the first or second base panels 212, 228 formed when the tab 272 is folded internally of the carrier 290. In this way the opening created in the first or second base panels 212, 228 by the tab 272 and the cutaway A2 are integral or combine to form a single aperture. The cutaway A2 is defined by a part of a notional triangle NT2, another part of which is accommodated within the tab 272. One of the vertices of the triangle is disposed outside footprint of the tab 272 such that the cutaway A2 is formed.

In the illustrated embodiment the side of the triangle opposing the vertex disposed outside the tab 272 is parallel with the fold line 275 hinging the tab 272 to the first or second base panels 212, 228.

Each of the tabs 272 second intermediate article engagement structures T9, T12 is defined by a cut line 277*a*/277*b*/277*c*, The cut line comprises a first portion 277*a*, a second portion 277*b* and a third portion 277*c*.

Terminal ends of the first and third portions 277*a*, 277*c* of the cut line 277*a*/277*b*/277*c*, adjacent to the fold line 275 are arcuate or curved in shape.

The fold line 275 extends between the curved ends of the cut line 277*a*/277*b*/277*c*. The cut line 277*a*/277*b*/277*c* is interrupted by the cutaway A2 such that two of the cut line portions 277*a*, 277*b* are disposed on a first side of the cutaway A2 and the other cut line portion 277*c* is disposed on the opposing side of the cutaway A2.

At least one of the cut line portions 277*a*/277*b*/277*c* may be shaped to provide a relief. In the illustrated embodiment the second cut line portion 277*b* provides a relief.

The relief facilitates engagement of the tab 272 with the base of an article B. The relief may define a non-securing or non-engaging edge of the tab 272. In this way the portion of the tab 272 defined by the relief is freely or readily movable between an engaged condition and a disengaged condition with the article B.

The second cut line portion 277*b* may be arranged to be spaced apart from an engaging surface provided by the article B. The engaging surface may take the form of a wall provided by a recess, upstand or flange extending from, or into, the base of the article B. In this way the second cut line portion 277*b* may not contact the article B. This may have the effect of reducing friction between the tab 272 and the article B so as to may engagement of the tab 272 with the article easier by reducing the force that needs to be applied when compared with the first and second illustrated embodiments.

In the illustrated embodiment the second cut line portion 277*c* is substantially linear in shape, this has the effect of truncating the tab 272. It will be appreciated that the second cut line portion 272*c* may be other shapes and still have the effect of truncating the tab 272, for example, but not limited to, the second cut line portion 277*c* may be re-entrant or concave, it may be non-linear or arcuate (also referred to herein as concavely curved), it may comprise two or more contiguous linear sections divergently arranged with respect to each other (also referred to herein as concavely angled).

Figure 7:
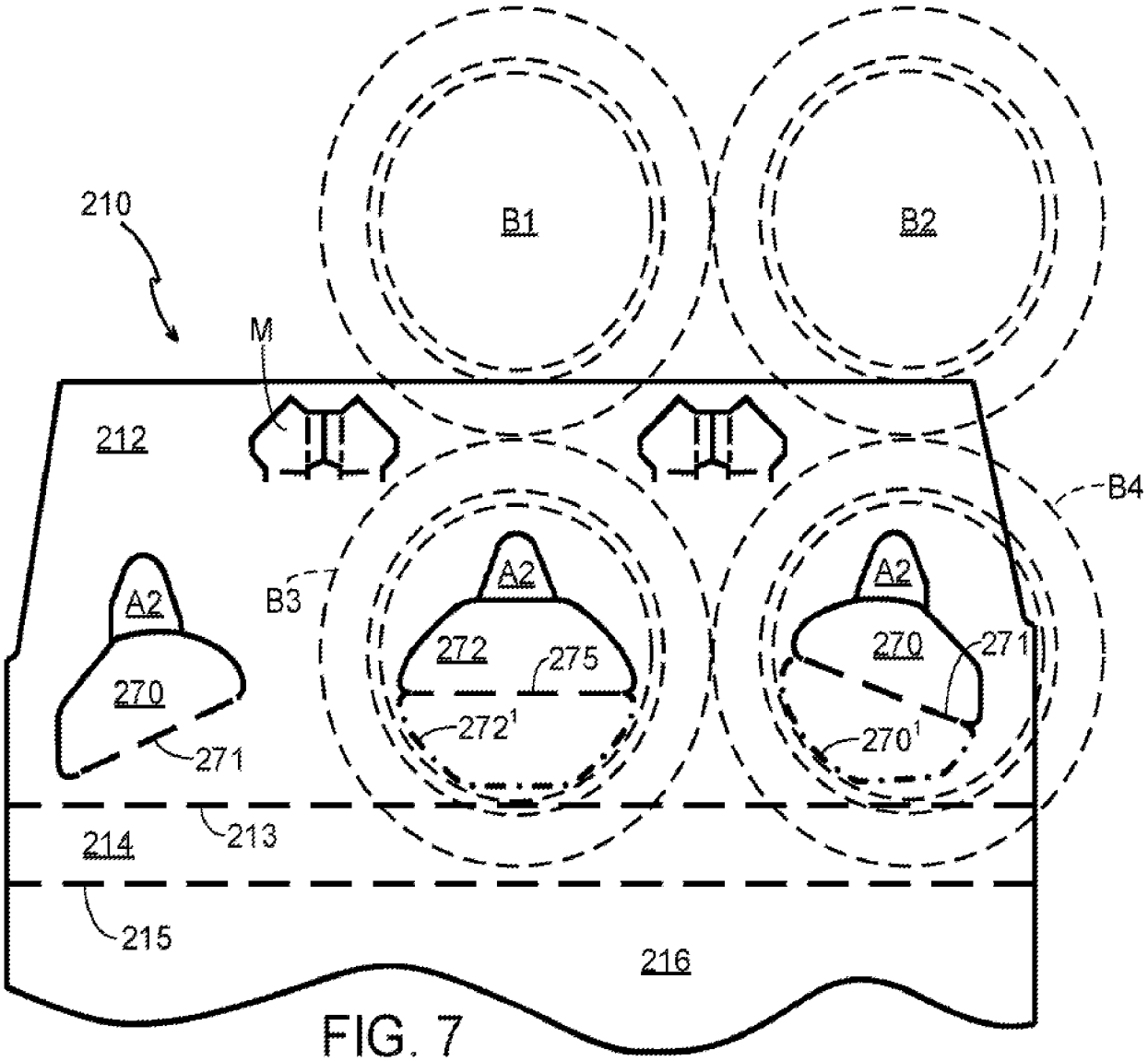
FIG. 7 is a plan view from above of a portion of the blank of FIG. 6 illustrating the positions of articles relative thereto.

In this way the tabs 270, 272 form article-engaging flaps hingedly connected to the bottom panel of the carton 290. The engaging flaps are defined in part by a free edge which includes a second or non-engaging segment 273*b*, 277*b* (defined by the second cut line portions 273*b*, 277*b*) forming a truncation or non-protrusion. The second segment 273*b*, 277*b* includes a part of the free edge which is disposed closest to a carton side panel 216, 224, in an erected, or folded, form of the carton; this is best illustrated in FIG. 7 in which the dot-dash lines indicate the folded or erected position of the tabs 270, 272. The dash lines indicate the positions of the articles B relative to the first base panel 212. The engaging flaps in the erected condition are folded inwardly through an angle greater than 90 degrees and toward the side panel 216.

The second segment 273*b*, 277*b* may be a straight segment, a re-entrant segment, a concave segment, a concavely curved segment or a concavely angled segment.

The free edge of the tabs 270, 272 comprise at least one engaging segment 273*c*, 277*a*, 277*c*. The engaging segment 273*b*, 277*b* (defined by the second and third cut line portions 273*c*, 277*a*, 277*c*) forms a protrusion, prominence or salient region.

The cutaway or notch A2 is located along a portion of the free edge of the tabs 270, 272 when the tab 270, 272 is in an unfolded condition. The second or truncated segment 273*b*, 277*b* is disposed adjacent to the cutaway or notch A2.

The second or truncated segment 277*b* of the second intermediate article engagement structures T9, T12 may be located such that it defines a part of the cutaway or notch A2 when the tab 272 is in the initial position.

The second or truncated segment 273*b* of the second end article engagement structures T1, T2, T7, T8 may be located such that it extends from the cutaway or notch A2 when the tab 270 is in the initial position.

The present disclosure provides an article carrier 90; 190; 290 and a blank 10; 110; 210 for forming an article carrier. The article carrier 90; 190; 290 and the blank 10; 110; 210 comprise at least one an article retention device T1, T2, T3, T4, T5, T6, T7, T8, T9, T10, T11, T12 for engaging a recess, upstand flange, or other suitable engaging surface provided by an article B. When the articles being packaged are cans the engaging surface may be provided by a seam or chime.

The article carrier 90; 190; 290 may package at least one article B having a recess. The blank 10; 110; 210 comprises a plurality of panels 12, 14, 16, 18, 20, 22, 24, 26, 28; 112, 114, 116, 118, 120, 122, 124, 126, 128; 212, 214, 216, 218, 220, 222, 224, 226, 228 for forming a tubular structure for surrounding one or more articles B. The blank 10; 110; 210 comprises an article retention device T1, T2, T3, T4, T5, T6, T7, T8 for engaging a recess of one of said one or more articles B. The article retention device T1, T2, T3, T4, T5, T6, T7, T8 may inhibit dislodgement of the article B from at least one of opposite open ends of the tubular structure of the article carrier 90; 190; 290. The tubular structure defines a tubular axis Ta. The article retention device T1, T2, T3, T4, T5, T6, T7, T8 comprises a flap 60, 70; 160, 170; 260, 270 hingedly connected to a first one 12, 20, 28; 112, 120, 128; 212, 220, 228 of the plurality of panels 12, 14, 16, 18, 20, 22, 24, 26, 28; 112, 114, 116, 118, 120, 122, 124, 126, 128; 212, 214, 216, 218, 220, 222, 224, 226, 228 along a first fold line 61, 71; 161, 171; 261, 271. The first fold line 61, 71; 161, 171; 261, 271 extends at an acute angle $\theta_1$, $\theta_2$ with respect to the tubular axis $T_a$. The acute angle $\theta_1$, $\theta_2$ may be no more than 50 degrees.

The flap 60, 70; 160, 170; 260, 270 may be hingedly connected such that the flap 60, 70; 160, 170; 260, 270 is foldable inwardly of the article carrier 90; 190; 290 toward a second one of the plurality of panels 14, 16, 24, 26; 114, 116, 124, 126; 216, 224 which is hingedly connected to the first one 12, 20, 28; 112, 120, 128; 212, 220, 228 of the plurality of panels along a second fold line 13, 15, 25, 27; 113, 115, 125, 127; 213, 215, 225, 227, the second fold line 13, 15, 25, 27; 113, 115, 125, 127; 213, 215, 225, 227 being parallel to the tubular axis $T_a$.

The flap 60, 70; 160, 170, 172; 260, 270, 272 may be defined, at least in part, by at least one cut line 73; 173, 177; 273*a*/273*b*/273*c*, 277*a*/277*b*/277*c* in the first one 12, 20, 28; 112, 120, 128; 212, 220, 228 of the plurality of panels, the at least one cut line 73; 173, 177; 273*a*/273*b*/273*c*, 277*a*/277*b*/277*c* has at least one curved end which is located adjacent to and curves toward one end of the first fold line 61, 71; 161, 171, 175; 261, 271, 275.

The at least one curved end may be connected to the one end of the first fold line 61, 71; 161, 171, 175; 261, 271, 275. The acute angle $\theta_1$, $\theta_2$ may be no less than 10 degrees and no more than 30 degrees.

The present disclosure also provides an article carrier 90; 190; 290 having a machine pull opening and a blank 10; 110; 210 for forming the same. The article carrier 90; 190; 290 and/or blank 10; 110; 210 comprises an article retention device T1, T2, T7, T8, T9, T12 for engaging a recess of one of at least one article B. The article retention device T1, T2, T7, T8, T9, T12 may inhibit dislodgement of the article B from at least one of opposite open ends of the tubular structure of the article carrier 90; 190; 290. The article retention device T1, T2, T7, T8, T9, T12 comprises a flap 70; 170, 172; 270, 272 struck from only a first one 12, 28; 112, 128; 212, 228 of the plurality of panels 12, 14, 16, 18, 20, 22, 24, 26, 28; 112, 114, 116, 118, 120, 122, 124, 126, 128; 212, 214, 216, 218, 220, 222, 224, 226, 228 and hingedly connected to the first one 12, 28; 112, 128; 212, 228 of the plurality of panels 12, 14, 16, 18, 20, 22, 24, 26, 28; 112, 114, 116, 118, 120, 122, 124, 126, 128; 212, 214, 216, 218, 220, 222, 224, 226, 228 along a first fold line 71; 171, 175; 271, 275. The flap 70; 170, 172; 270, 272 when folded about the first fold line 71; 171, 175; 271, 275, defines at least part of a machine pull opening. A machine element may engage the machine pull opening to tighten the blank 10; 110 around the at least one article B. The flap 70; 170, 172; 270; 272 may be a single or unitary member formed from the material removed out from the machine pull opening.

The machine pull opening may include a recess A1, A2 along a perimeter of the machine pull opening, the recess A1, A2 being located at a position opposing the first fold line 71; 171, 175; 271, 275.

The machine pull opening may include a recess A1, A2 along a perimeter of the machine pull opening, the recess A1, A2 being located at a position across the machine pull opening from the first fold line 71; 171, 175; 271, 275.

The flap 70; 170, 172; 270, 272 is defined at least in part by a cut line 73; 173, 177; 273*a*/273*b*/273*c*, 277*a*/277*b*/277*c* in the first one 12, 28; 112, 128; 212, 228 of the plurality of panels, the recess A1, A2 being located such that the recess A1, A2 interrupts the cut line 73; 173, 177; 273*a*/273*b*/273*c*, 277*a*/277*b*/277*c* and divides the cut line 73; 173, 177; 273*a*/273*b*/273*c*, 277*a*/277*b*/277*c* into two portions, the two portions of the cut line 73; 173, 177273*a*/273*b*/273*c*, 277*a*/277*b*/277*c* extending respectively from the recess A1, A2 to opposite ends of the first fold line respectively 71; 171, 175; 271, 275.

The present disclosure further provides a blank 10; 110; 210 for forming an article carrier 90; 190; 290. The article carrier 90; 190; 290 may package at least one article B having a recess. The blank 10; 110; 210 comprises a plurality of panels 12, 14, 16, 18, 20, 22, 24, 26, 28; 112, 114, 116, 118, 120, 122, 124, 126, 128; 212, 214, 216, 218, 220, 222, 224, 226, 228 for forming a tubular structure for surrounding at least one article B. The blank 10; 110; 210 comprises an article retention device T1, T2, T3, T4, T5, T6, T7, T8 for engaging a recess of one of said at least one article B. The article retention device T1, T2, T3, T4, T5, T6, T7, T8 may inhibit dislodgement of the article B from at least one of opposite open ends of the tubular structure in a setup carrier 90; 190; 290. The blank 10; 110; 210 comprises a longitudinal axis La. The article retention device T1, T2, T3, T4, T5, T6, T7, T8 comprises a flap 60, 70; 160, 170; 260; 270 hingedly connected to a first one 12, 20, 28; 112, 120, 128; 212, 220, 228 of the plurality of panels 12, 14, 16, 18, 20, 22, 24, 26, 28; 112, 114, 116, 118, 120, 122, 124, 126, 128; 212, 214, 216, 218, 220, 222, 224, 226, 228 along a first fold line 61, 71; 161, 171; 261, 271. The first fold line 61, 71; 161, 171; 261; 271 extends at an acute angle $\theta_3$, $\theta_4$ with respect to the longitudinal axis $L_a$. The acute angle $\theta_3$, $\theta_4$ may be greater than or equal to 40 degrees and less than 90 degrees.

The present disclosure provides an article carrier 90; 190; 290 for packaging at least one article B having a recess. The article carrier 90; 190; 290 comprises a plurality of panels 12, 14, 16, 18, 20, 22, 24, 26, 28; 112, 114, 116, 118, 120, 122, 124, 126, 128; 212, 214, 216, 218, 220, 222, 224, 226, 228 for forming a tubular structure for surrounding at least one article B. The article carrier 90; 190; 290 comprises an article retention device T1, T2, T3, T4, T5, T6, T7, T8 for engaging a recess of one of said at least one article B so as to inhibit dislodgement of the article B from at least one of opposite open ends of the tubular structure. The article carrier 90; 190; 290 comprises a transverse axis La. The transverse axis La is perpendicular to a tubular axis $T_a$ of the tubular structure. The article retention device T1, T2, T3, T4, T5, T6, T7, T8 comprises a flap 60, 70; 160, 170; 260, 270 hingedly connected to a first one 12, 20, 28; 112, 120, 128; 212, 220, 228 of the plurality of panels 12, 14, 16, 18, 20, 22, 24, 26, 28; 112, 114, 116, 118, 120, 122, 124, 126, 128; 212, 214, 216, 218, 220, 222, 224, 226, 228 along a first fold line 61, 71; 161, 171; 261, 271. The first fold line 61, 71; 161, 171; 261, 271 extends at an acute angle $\theta_3$, $\theta_4$ with respect to the transverse axis $L_a$. The acute angle $\theta_3$, $\theta_4$ may be greater than or equal to 40 degrees and less than 90 degrees.

The article carrier 90; 190; 290 may be of the wrap-around type, comprising a composite wall formed from two panels secured together. The composite wall may be a bottom wall of the tubular structure.

It can be appreciated that various changes may be made within the scope of the present invention. For example, the size and shape of the panels and apertures may be adjusted to accommodate articles of differing size or shape. The illustrated embodiments show cartons or blanks for forming an article carrier of the wraparound style; in other embodiments, the article carrier may take an alternative format or styles and may employ one or more of the features of the present disclosure.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming an article carrier, comprising:
- a plurality of panels for forming a tubular structure for surrounding at least one article having a recessed portion, the plurality of panels comprising a top panel, a first side panel, and a second side panel;
- a handle structure formed from the top panel, the handle structure comprising:
  - a handle extending, between the first side panel and the second side panel, in a transverse direction that is substantially perpendicular to a longitudinal axis of the blank, the handle comprising a side edge configured to be gripped by a user; and
  - an engaging flap hingedly connected by a flap fold line that forms an edge of the top panel,
- wherein the engaging flap is configured to engage with the recessed portion of the at least one article, and
- wherein the edge of the top panel extends from the side edge of the handle.

2. The blank of claim 1, wherein the handle is defined, at least in part, by a first recess formed at a first top end of the top panel and a second recess formed at a second top end of the top panel that opposes the first top end.

3. The blank of claim 2, further comprising: a pair of flaps, each disposed on an opposing side of the handle and hingedly connected thereto.

4. The blank of claim 3, wherein the pair of flaps is defined, at least in part, by the first recess and the second recess, respectively.

5. The blank of claim 4, wherein the pair of flaps is configured to extend or enlarge the first recess and the second recess, respectively.

6. The blank of claim 3, wherein at least one of the pair of flaps is configured to extend between the engaging flap and another engaging flap formed on the top panel.

7. The blank of claim 6, wherein the at least one of the pair of flaps is separated from the engaging flap and the other engaging flap by respective cuts.

8. The blank of claim 3, wherein the side edge of the handle is formed by a fold line that hingedly connects one of the pair of flaps.

9. An article carrier for packaging at least one article having a recessed portion, the article carrier comprising:
- a plurality of panels for forming a tubular structure for surrounding the at least one article and having a tubular axis, the plurality of panels comprising a top panel, a first side panel, and a second side panel;
- a handle structure formed from the top panel, the handle structure comprising:
  - a handle extending, between the first side panel and the second side panel, in a transverse direction that is substantially perpendicular to the tubular axis, the handle comprising a side edge configured to be gripped by a user; and
  - an engaging flap hingedly connected by a flap fold line that forms an edge of the top panel, wherein the engaging flap is configured to engage with the recessed portion of the at least one article, and wherein the edge of the top panel extends from the side edge of the handle.

10. The article carrier of claim 9, wherein the handle is defined, at least in part, by a first recess formed at a first top end of the top panel and a second recess formed at a second top end of the top panel that opposes the first top end.

11. The article carrier of claim 10, further comprising: a pair of flaps, each disposed on an opposing side of the handle and hingedly connected thereto, wherein the pair of flaps is defined, at least in part, by the first recess and the second recess, respectively.

12. The article carrier of claim 11, wherein the pair of flaps is configured to extend or enlarge the first recess and the second recess, respectively.

13. The article carrier of claim 11, wherein the side edge of the handle is formed by a fold line that hingedly connects one of the pair of flaps.

14. A handle structure formed from a top panel of a carton for packaging a plurality of articles or a group of articles, the handle structure comprising:

a handle extending, between a first side panel and a second side panel of the carton, in a transverse direction that is substantially perpendicular to a tubular axis of the carton, the handle comprising a side edge configured to be gripped by a user; and an engaging flap hingedly connected by a flap fold line that forms an edge of the top panel, wherein the engaging flap is configured to engage with at least one of the articles, and wherein the edge of the top panel extends from the side edge of the handle.

15. The handle structure of claim 14, wherein the handle is defined, at least in part, by a first recess formed at a first top end of the top panel and a second recess formed at a second top end of the top panel that opposes the first top end.

16. The handle structure of claim 15, further comprising: a pair of flaps, each disposed on an opposing side of the handle and hingedly connected thereto.

17. The handle structure of claim 16, wherein the pair of flaps is defined, at least in part, by the first recess and the second recess, respectively.

18. The handle structure of claim 17, wherein the pair of flaps is configured to extend or enlarge the first recess and the second recess, respectively.

19. The handle structure of claim 16, wherein at least one of the pair of flaps is configured to extend between the engaging flap and another engaging flap formed on the top panel.

20. The handle structure of claim 16, wherein the side edge of the handle is formed by a fold line that hingedly connects one of the pair of flaps.

* * * * *